US005858601A

United States Patent [19]

Ong et al.

[11] Patent Number: 5,858,601

[45] Date of Patent: Jan. 12, 1999

[54] TONER PROCESSES

[75] Inventors: Beng S. Ong; T. Hwee Ng; Walter Mychajlowskij, all of Mississauga; Raj D. Patel, Oakville; Patricia A. Burns, Milton, all of Canada

[73] Assignee: Xerox Corporation, Stamford, Conn.

[21] Appl. No.: 127,851

[22] Filed: Aug. 3, 1998

[51] Int. Cl.[6] ..... G03G 9/093

[52] U.S. Cl. ..... 435/137

[58] Field of Search ..... 430/137

[56] References Cited

U.S. PATENT DOCUMENTS

| | | | |
|---|---|---|---|
| 4,137,188 | 1/1979 | Uetake et al. | 430/111 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/137 |
| 5,650,255 | 7/1997 | Ng et al. | 430/137 |
| 5,650,256 | 7/1997 | Veregin et al. | 430/137 |
| 5,747,215 | 5/1998 | Ong et al. | 430/137 |
| 5,763,133 | 6/1998 | Ong et al. | 430/137 |

*Primary Examiner*—Roland Martin
*Attorney, Agent, or Firm*—E. O. Palazzo

[57] ABSTRACT

A process for the preparation of toner comprising (i) blending (a) a colorant dispersion containing a first ionic surfactant with (b) a latex emulsion comprised of an aqueous dispersion of core-shell polymer particles with a crosslinked polymer core and a linear polymer shell, and optional nonionic surfactant and a second ionic surfactant with a charge polarity opposite to that of said first ionic surfactant in said colorant dispersion;

(ii) heating the resulting mixture at about below the glass transition temperature (Tg) of the linear latex shell polymer to form aggregates; and (iii) subsequently heating said aggregates about above the Tg of the linear latex shell polymer to effect coalescence and fusion of said aggregates.

30 Claims, No Drawings

TONER PROCESSES

PATENTS AND PENDING APPLICATION

Illustrated in U.S. Pat. No. 5,763,133, and U.S. Pat. No. 5,747,215 the disclosures of each being totally incorporated herein by reference, is for example, a process for the preparation of toner comprising for U.S. Pat. No. 5,763,133

(i) blending (a) an aqueous pigment dispersion containing a first ionic surfactant and an optional charge control agent with (b) a latex blend comprised of linear polymer and crosslinked polymer particles, optional nonionic surfactant and a second ionic surfactant with a charge polarity opposite to that of the first ionic surfactant in the pigment dispersion;

(ii) heating the resulting mixture at about below the glass transition temperature (Tg) of the linear latex polymer to form toner sized aggregates; and (iii) subsequently heating the aggregates about above the Tg of the linear latex polymer to effect fusion or coalescence of said aggregates; and for U.S. Pat. No. 5,747,215 a process for the preparation of toner comprising (i) blending (a) a colorant dispersion containing a first ionic surfactant and an optional charge control agent with (b) a latex blend comprised of linear polymer and crosslinked polymer particles, optional nonionic surfactant and a second ionic surfactant with a charge polarity opposite to that of the first ionic surfactant in the colorant dispersion;

(ii) heating the resulting mixture at about below the glass transition temperature (Tg) of the linear latex polymer to form toner sized aggregates; and (iii) subsequently heating the aggregates about above the Tg of the linear latex polymer to effect fusion or coalescence of said aggregates, and wherein said linear polymer is of an $M_w$ of from about 20,000 to about 40,000.

In copending application U.S. Ser. No. 031,345, the disclosure of which is totally incorporated herein by reference, there is disclosed a process for the preparation of a latex comprising a core polymer and a shell thereover and wherein the core polymer is generated by (A)

(i) emulsification and heating of monomer, chain transfer agent, water, surfactant, and initiator;

(ii) generating a seed latex by the aqueous emulsion polymerization of a mixture comprised of part of the (i) monomer emulsion, from about 0.5 to about 50 percent by weight, and an optional free radical initiator, and which polymerization is accomplished by heating;

(iii) heating and adding to the formed seed particles of (ii) the remaining monomer emulsion of (I), from about 50 to about 99.5 percent by weight of monomer emulsion of (i) and free radical initiator;

(iv) whereby there is provided the core polymer; and (B) forming a shell thereover the core generated polymer and which shell is generated by emulsion polymerization of a second monomer in the presence of the core polymer, which emulsion polymerization is accomplished by (i) emulsification and heating of monomer, chain transfer agent, surfactant, and an initiator;

(ii) adding a free radical initiator and heating;

(iii) whereby there is provided said shell polymer.

The appropriate components and processes of the above patents and copending application may be selected for the present invention in embodiments thereof.

BACKGROUND OF THE INVENTION

The present invention is generally directed to toner processes, and more specifically, to chemical processes wherein there is accomplished the aggregation of latex, colorant particles, and optional additives to enable toner compositions. More specifically, the present invention is related to the direct in-situ chemical preparation of toner compositions without the need for conventionally known toner pulverization and classification methods, and wherein in embodiments toner compositions with a volume average diameter of from about 1 to about 25, and preferably from 2 to about 10 microns, and narrow particle size distribution as conventionally characterized by GSD (geometric standard deviation) of, for example, less than 1.35, more specifically, less than about 1.25, and, for example, from about 1.15 to about 1.25, as measured on the Coulter Counter, and which toners possess tunable gloss characteristics, for example from low, about 10 to about 80 Gardner Gloss units (GGU), can be obtained. The resulting toners can be selected for known electrophotographic processes and printing processes, including digital processes, and particularly color xerographic imaging and printing processes. The invention toners are particularly useful for the development of colored images with excellent (1) image resolution, (2) high color fidelity, (3) gloss uniformity, and (4) acceptable projection efficiency.

The image gloss characteristics of the toner compositions of the present invention in embodiments can be controlled primarily by the amount of the crosslinked polymer core particles, crosslink density, and composition. Specifically, lower image gloss levels of for example less than about 30, for example about 5 to about 30 GGU are obtained from toners with higher contents for example about 20 weight percent of crosslinked polymer core particles. Accordingly, a wide range of image gloss level ranging from below about 20 to in excess of about 70 GGU as measured by the Gardner Gloss metering instrument can be designed to provide specific image appearance requirements. In general, the image gloss requirement of a document is dictated by its application; for example, for process color, glossy images are highly desirable. For text, highlight and graphic documents, a matte image finish is generally preferred.

More specifically toners prepared in accordance with the present invention enable in embodiments the generation of high quality images with specifically preselected image gloss levels, and lower toner fusing temperatures, such as from about 120° C. to about 170° C., thereby eliminating or minimizing paper curl while prolonging the life of fuser rolls.

In color xerographic systems, small sized toners of preferably from about 2 to about 7 microns are important to the achievement of high image quality for process color applications. It is also important to have a low image pile height to eliminate image feel and avoid, or minimize paper curling after fusing. Paper curling can be particularly pronounced in xerographic color processes in which relatively high toner coverage as a result of the application of three to four color toners. During the fusing step, moisture is driven off from the paper due to high fusing temperatures of from about 120° C. to 200° C. With only one layer of toner, such as in one-color black or highlight color xerographic applications, the amount of moisture driven off during fusing can usually be reabsorbed back by the paper and the resulting print remains relatively flat with minimal paper curl. In process color processes where toner coverage is high, the relatively thick toner plastic covering on the paper can inhibit the paper from reabsorbing the moisture, and lead to substantial paper curling. These and other imaging shortfalls and problems are avoided or minimized with the toners and processes of the present invention.

Also, it is preferable to use small toner particle sizes, such as from about 2 to 7 microns, and with higher pigment loading, such as from about 4 to about 15 percent by weight of toner, so that the mass of toner necessary for attaining the required optical density and color gamut can be significantly reduced to eliminate or minimize image feel and paper curl.

PRIOR ART

Emulsion/aggregation/coalescense processes and related processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935.

Other prior art that may be of interest includes U.S. Pat. Nos. 4,558,108, 4,797,339, 4,996,127, 4,983,488, 3,674,736, 4,137,188 and 5,066,560.

The appropriate components and processes of the above patents, especially the above Xerox patents can be selected for the toners and processes of the present invention in embodiments.

SUMMARY OF THE INVENTION

Examples of the features of the present invention in embodiments thereof include:

It is an feature of the present invention to provide toner processes with many of the advantages illustrated herein, such as the use of core-shell latex particles wherein a single latex is utilized for toner aggregation, and there is permitted a uniform dispersion of crosslinked polymer particles within the toner. The uniform dispersion of crosslinked polymer particles within the toner ensures for example, toner performance consistency and the achievement of uniform image gloss characteristics.

In another feature of the present invention there are provided simple and economical processes for the preparation of black and colored toner compositions with, for example, smaller particle size of about 2 to about 10 microns and narrow GSD of less than about 1.35, and more specifically, less than about 1.25.

A further feature of the present invention is the provision of colored toner compositions with excellent colorant dispersion, thereby enabling excellent color mixing quality and acceptable projection efficiency.

Still in a further feature of the present invention there are provided toner processes for colored toner compositions with image gloss characteristics that can be adjusted to, for example, satisfy customer image appearance requirements.

In a further feature of the present invention there is provided a process for the preparation of toner compositions with a toner size of from between about 1 to about 25 microns, and preferably from about 2 to about 7 microns in volume average particle diameter, and a narrow GSD of less than about 1.35, and preferably less than about 1.25 as measured by a Coulter Counter, and wherein the toner image gloss characteristics can be adjusted.

Another feature is the provision of a chemical process for the preparation of toner compositions with tunable image gloss properties and which process comprises the aggregation and coalescence of a latex comprised of a crosslinked core resin and a layer, or coating thereover of linear resin, a colorant, such as a pigment, dye, or mixtures thereof, and optional additives, and wherein the toner particle size is achieved by, for example, control of the process temperature.

In an associated feature of the present invention there are provided toner compositions and images developed thereof, and wherein the image gloss characteristics are controlled by the nature and amount of the crosslinked polymer particles.

In a further associated feature of the present invention there are provided toner compositions with image gloss levels of from below about 20 to over 70 GGU as measured by Gardner Gloss meter.

In yet another feature of the present invention there are provided toner compositions which enable lower fusing temperatures of from about 120° C. to about 170° C., and which toners possess excellent toner blocking resistance.

Moreover, in another feature of the present invention there are provided toner compositions with excellent image projection efficiency, such as from about 65 to over 80 percent as measured by the Match Scan II spectrophotometer available from Milton-Roy.

In a further feature of the present invention there are provided toner compositions which, when properly fused on paper, avoid, or minimize paper curl; wherein crosslinked polymer incorporated toners can be prepared, and more specifically, wherein the crosslinked polymer particles are contained in the toners, and wherein with such toners photoreceptor filming is minimized, and wire contamination on development wires is avoided or minimized; and wherein image gloss and image matte is achievable, and wherein colorant passivation can be achieved.

In aspects thereof, the present invention relates a process for the preparation of toner comprising (i) blending (a) a colorant dispersion containing a first ionic surfactant with (b) a latex emulsion comprised of an aqueous dispersion of core-shell polymer particles with a crosslinked polymer core and a linear polymer shell, and optional nonionic surfactant and a second ionic surfactant with a charge polarity opposite to that of said first ionic surfactant in said colorant dispersion;

(ii) heating the resulting mixture at about below the glass transition temperature (Tg) of the linear latex shell polymer to form aggregates; and (iii) subsequently heating said aggregates about above the Tg of the linear latex shell polymer to effect coalescence and fusion of said aggregates; a toner process wherein the temperature at which the aggregates are formed in (ii) controls the size of said aggregates, and which aggregates are from about 2 to about 10 microns in volume average diameter; a toner process wherein the crosslinked polymer is a linear polymer that has been crosslinked; a toner process wherein the crosslinked core polymer is selected from the group consisting of crosslinked poly(styrene-alkyl acrylate), poly(styrene-butadiene), poly(styrene-isoprene), poly (styrene-alkyl methacrylate), poly(styrene-alkyl acrylate-acrylic acid), poly(styrene-butadiene-acrylic acid), poly (styrene-isoprene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), and poly(alkyl acrylate-acrylonitrile-acrylic acid); a toner process wherein the crosslinked polymer particles are present in an amount of from about 0.1 to about 70 weight percent, or wherein the crosslinked polymer particles are present in an amount of from about 20 to about 50 weight percent of the toner, and wherein the linear polymer is present in an amount of from about 25 to about 95 weight percent of the toner, or wherein the linear polymer is present in an amount of from about 40 to about 75 weight percent of the toner; a toner process wherein the linear shell polymer $M_w$ is from about 15,000 to about 50,000, and the crosslinked polymer is optionally derived from the polymerization of vinyl monomers with a crosslinking agent in the amount of from 0.01 to over 20 weight percent of total monomers; a toner process wherein the toner possesses an image gloss value of from about 5 GGU to about 75 GGU; a toner process wherein the surfactant in the aqueous colorant dispersion is a cationic surfactant, the surfactant in the latex blend is comprised of nonionic and anionic surfactants, or the surfactant in the colorant dispersion is an anionic surfactant, and the surfactant in the latex blend is comprised of nonionic and cationic surfactants; a toner process wherein the colorant dispersion contains water and is prepared by homogenizing a colorant in water in the presence of a suitable surfactant, which homogenizing is at from about 1,000 revolutions per minute to about 10,000 revolutions per minute, at a temperature of from about 25° C. to about 55° C., and for a duration of from about 1 minute to about 120 minutes; a toner process wherein the colorant dispersion is prepared by mixing a colorant in water with an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes; a toner process wherein the heating (ii) is accomplished at temperatures of from about 25° C. to about 1° C. below the Tg of the linear shell polymer for a duration of from about 0.5 hour to about 6 hours; a toner process wherein the linear shell polymer is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(styrene-butyl acrylate-acrylonitrile-acrylic acid), poly(acrylonitrile-butyl acrylate-acrylic acid), and the crosslinked polymer is comprised of said linear polymer with crosslinking; a toner process wherein the linear shell polymer is poly(styrene-butylacrylate), poly(styrene-butyl acrylate-acrylic acid), poly(styrene-butadiene), poly(styrene-butadiene-acrylic acid), poly(styrene-butyl acrylate-acrylonitrile), or poly (styrene-butyl acrylate-acrylonitrile-acrylic acid), and the crosslinked resin is the crosslinked derivative of poly (styrene-butyl acrylate), poly(styrene-butyl acrylate-acrylic acid), poly(styrene-butadiene), poly(styrene-butadiene-acrylic acid), poly(styrene-butyl acrylate-acrylonitrile), or poly(styrene-butyl acrylate-acrylonitrile-acrylic acid); a toner process wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol, and wherein the ionic surfactant is selected from the group consisting of sodium dodecyl sulfate, sodium dodecylbenzene sulfate, sodium dodecylnaphthalene sulfate; a toner process wherein the colorant is carbon black, cyan, yellow, magenta, or mixtures thereof; a toner process wherein the surfactants are each present in an amount of from about 0.1 to about 5 weight percent of the reaction mixture; a toner process wherein there is added to the surface of the formed toner metal salts, metal salts of fatty acids, silicas, metal oxides, or mixtures thereof, each in an amount of from about 0.1 to about 10 weight percent of the obtained toner; a toner process wherein subsequent to (iii) cooling is accomplished and the resulting toner is washed with water or aqueous base at a temperature of from about 25° to about 75° C. primarily to remove residual surfactants from the toner, and wherein the coalescence and fusion (iii) is accomplished at a temperature of from about 10° to about 50° C. above the Tg of the linear shell polymer, or at a temperature of about 80° to about 100° C.; a toner process wherein the shell is of a thickness of from about 5 nanometers to about 300 nanometers; a toner process for the preparation of a core-shell comprised of the polymerization of vinyl monomers onto a crosslinked polymer seed, and which core shell can be selected for the preparation of the toner compositions; a toner process wherein there is provided mechanically stable integral toner particles of polymers and colorant; a toner process wherein subsequent to (iii) the suspension is cooled, and the toner is isolated; a process comprising (i) mixing (a) a colorant containing a first ionic surfactant with (b) a latex emulsion, and wherein the latex is comprised of a crosslinked polymer core and a linear polymer shell, and a second ionic surfactant with a charge polarity opposite to that of said first ionic surfactant in said colorant;

(ii) heating the resulting mixture at about equal to, or about below the glass transition temperature (Tg) of the linear latex shell polymer;

(iii) heating said resulting mixture suspension about equal to, or about above the Tg of the linear latex shell polymer; and optionally cooling, and optionally isolating the product; a toner process wherein the heating in (ii) results in the formation of aggregates, the heating in (iii) results in the fusion of the aggregates, the product is isolated, and which product is a toner; a toner process wherein the latex is generated by the emulsion polymerization of a mixture of monomers and crosslinking component, followed by the addition of monomers and polymerization to enable said latex with a crosslinked core polymer and a shell polymer thereover; a toner process wherein the polymerization of the monomers to provide the core polymer is accomplished by heating at a temperature of about 50° C. to about 95° C., the amount of crosslinking component is from about 0.1 to about 20 weight percent of total monomers, the crosslinked core particles possess a size diameter of about 25 to about 300 nanometers, cooling is accomplished after core polymer polymerization, the linear shell polymer is formed on the core polymer particles by simultaneous feedings of an aqueous monomer dispersion and an aqueous initiator solution into the core polymer particle suspension at a temperature of about 50° C. to about 95° C. over a period of about 30 minutes to 6 hours, the shell polymer $M_w$ is about 15,000 to about 40,000, and its $M_n$ is about 4,000 to about 15,000; a toner process wherein the image gloss value of the toner obtained from the said latex is about 5 to about 75 GGU, and the MFT of the toner is about 120° to about 185° C.; a toner process wherein the toner resulting is washed to primarily remove surfactants; a toner process wherein the toner possesses an image gloss value of about 75 GGU at the toner MFT melt fusing temperature of from about 120° to about 185° C.; a toner process wherein the toner possesses a low gloss values enabled by the presence of from about 5 to about 70 weight percent of crosslinked polymer particles; and toner processes comprised of aggregating a latex, comprised of a shell of a linear polymer and a core contained therein of a crosslinked polymer, with an aqueous colorant dispersion and optional charge additives at a temperature below about, or in embodiments equal to about the glass transition temperature (Tg) of the linear latex polymer, for example generally from about 25° C. to about 1° C. below the Tg of the linear latex shell polymer, to form toner sized aggregates, followed by coalescing and/or fusing together the aggregates to form mechanically stable integral particles by heating at a temperature of from for example about 10° C. to about 50° C. above the Tg of the linear latex shell polymer for an effective time period, for example from about 30 minutes to about several, for example 25, hours. The latex utilized in the process of the present invention generally contains an ionic surfactant and an optional nonionic surfactant, and the colorant dispersion contains an ionic surfactant that is of an opposite charge polarity to the ionic surfactant in the latex emulsion. The mixing of the latex with the colorant dispersion permits flocculation of the latex and the colorant particles, which flocculent mixture on gentle stirring with controlled heating, enables the formation of toner sized aggregates with narrow particle size distribution. The latex size is generally in the range of from, for example, about 0.02 micron to about 2 microns in volume average diameter, while the colorant size is from, for example, about 0.05 micron to about 1.0 micron. The amount of each of the ionic surfactants utilized in the process in embodiments is from about 0.01 to about 5 weight percent, and the nonionic stabilizers, or surfactants are present in the latex emulsion in amounts of from about 0 to about 5 weight percent of the total reaction mixture. The resulting toners in embodiments possess a variety of image gloss characteristics with their image gloss levels being primarily determined by the amount of the crosslinked polymer particles present in the toner and in the final toner composition.

Aspects of the present invention relate to toners with image gloss values of, for example, from less than about 20, for example about 15, to over 60 GGU, for example about 75; (the ability to adjust the image gloss of a toner is particularly important in color applications as proper gloss matching between image and paper is highly desirable; for example, when a low gloss image of less than about 30 GGU is desired, low gloss paper is utilized; in contrast, for process color applications where glossier coated paper is generally employed to enhance image appearance, higher gloss images with gloss levels of from about 50 to over about 80 GGU are preferred); a process for obtaining toner compositions with, for example, specific image gloss characteristics, and which process is comprised of aggregating a latex emulsion comprised of aqueous dispersion of core-shell particles having a linear polymer shell and a crosslinked polymer core, colorant, and optional additive components into toner sized aggregates, followed by coalescing or fusing together the aggregates to form integral composite toner particles; a chemical toner process comprised of first blending by high shear mixing an aqueous colorant dispersion containing a colorant, such as green, blue, red, yellow, brown, orange, and the like, and more specifically, HELIOGEN BLUE™ or HOSTAPERM PINK™, and a cationic surfactant, such as benzalkonium chloride (SANIZOL B50™), with a latex blend comprised of a core of a crosslinked polymer encompassed by a shell thereover of a liner polymer, which latex can be stabilized with an anionic surfactant, such as sodium dodecylbenzene sulfonate, for example NEOGEN R™ or NEOGEN SC™, and a nonionic stabilizer such as alkyl phenoxy poly (ethyleneoxy)ethanol, for example IGEPAL 897™ or ANTAROX 897™, and which latex have a particle size of from, for example, about 0.05 to about 2.0 microns in volume average diameter as measured by the Brookhaven nanosizer, and optional additives; and wherein mixing of the latex emulsion, colorant dispersion, and optional additives induces flocculation of the latex, colorant, optional additive particles and surfactants, which flocculent mixture on heating at a temperature of from about 25° C. below to about 1° C. below the Tg of the linear latex shell polymer, results in the formation of electrostatically bound aggregates ranging in size of, for example, from about 2 microns to about 10 microns in volume average diameter as measured by the Coulter Counter; subsequently, heating the resulting aggregate suspension at about 10° C. to about 50° C. above the Tg of the linear latex shell polymer in the presence of additional anionic surfactant to convert the aggregates into mechanically stable toner particles; toner processes comprising the aggregation of core-shell latex particles, pigment, and additive particles to form toner sized aggregates, followed by fusion or coalescence of the constituents of the aggregates to form integral toner particles, and wherein the temperature of aggregation is utilized to control the aggregate size, and thus the final toner size, and wherein there is selected a linear shell polymer and a crosslinked core polymer; processes for the preparation of toner compositions which processes comprise initially blending an aqueous pigment dispersion containing a colorant, such as carbon black like REGAL 330®, phthalocyanine, quinacridone or RHODAMINE B™, and a cationic surfactant, such as benzalkonium chloride, by means of a high shearing device, such as a Brinkmann polytron, or a sonicator or microfluidizer, with a core/shell latex, and which latex contains an anionic surfactant such as sodium dodecylbenzene sulfonate and a nonionic surfactant; heating the resultant flocculent mixture with stirring at a temperature of from about 25° C. to about 1° C. below the Tg of the linear latex shell polymer to form toner sized aggregates ranging in volume average diameter of from about 1 to about 15 microns, and preferably from about 2 to about 10 microns; and further heating the mixture at a temperature of from about 10° C. to 50° C. (Centigrade) above the Tg of the linear latex shell polymer to effect fusion or coalescence of the constituents of the aggregates and to form integral toner particles; cooling; followed by washing with, for example, water to remove, for example, surfactants, and drying such as by means of an oven, Aeromatic fluid bed dryer, freeze dryer, or spray dryer, whereby toner particles of particle size of from about 1 to about 15 microns in volume average particle diameter and GSD of less than 1.35 as measured by the Coulter Counter, and with image gloss values of from less than 20 to over 70 GGU are obtained; and processes comprising (i) blending a colorant dispersion containing an ionic surfactant, with a latex emulsion comprised of aqueous dispersion of core-shell particles having (a) a linear polymer shell, and (b) a core of a crosslinked polymer, in the presence of a nonionic surfactant and an ionic surfactant that is of opposite charge polarity to the ionic surfactant in the pigment dispersion;

(ii) heating the resulting homogenized mixture at a temperature of from about 25° C. to about 1° C. below the Tg of the linear latex shell polymer, thereby effecting the formation of toner sized aggregates with, for example, a volume average diameter of from about 1 to about 12 microns, and a GSD of about equal to, or less than about 1.35, and preferably less than 1.25, for example about 1.15 to about 1.23; and thereafter (iii) heating the resulting aggregate suspension with additional ionic surfactant of opposite charge polarity to the surfactant of the pigment dispersion to, for example, from about 60° C. to about 110° C. to primarily permit coalescence and fusion of the constituents, or components of the aggregates to form integral toner particles; and subsequently cooling to about room temperature, about 25 degrees Centigrade;

(iv) isolating the toner product by washing and drying using appropriate conventional methods, such as washing with water, and solvents, and drying in an oven, and more specifically the processes of the present invention relate to heating the resulting flocculent suspension at a temperature of, for example, from about 25° C. to about 1° C. below the Tg of the linear latex polymer, while continuously stirring to effect formation of relatively stable toner sized aggregates of latex, pigment, and optional charge additive particles, and heating the resulting aggregate suspension with additional surfactant of opposite charge of the colorant surfactant at temperatures of from about 5° C. to 50° C. above the Tg of the linear latex polymer of, for example, from about 45° C. to about 65° C. to enable fusion of coalescence of the aggregate components to form mechanically stable, and morphologically useful forms of the toner comprised of linear polymer, crosslinked polymer, colorant, and optionally a charge control agent; cooling to about 25° C., separating the toner particles from water by filtration; and drying the toner particles.

Preferably the latex selected is comprised of a crosslinked core polymer and a linear polymer shell and which latex is prepared by the emulsion polymerization of a monomer or monomers in the presence of a crosslinking agent and wherein there results an aqueous suspension of crosslinked polymer particles, and which particles are for example from about 25 to about 250 nanometers in diameter. Subsequently there are added to an aqueous suspension comprised of for example, crosslinked latex particles, at a temperature of from about 40° to about 95° C., an aqueous emulsion of for example, vinyl monomers and chain transfer agents, and an aqueous initiator solution in a continuous manner over a period of from about 30 minutes to about 10 hours to effect polymerization of the monomers on the crosslinked polymer particles, and permitting shell formation thereon. The resulting latex contains latex particles which are comprised of a crosslinked polymer core, and thereon a linear polymer shell. This latex product can then be selected for the preparation of toners utilizing, for example, the aggregation/coalescence processes illustrated herein and in the Xerox patents recited herein. The gloss characteristics of the resulting toner of binder and colorant can be controlled by the crosslinked polymer core and the amount or degree of crosslinking, and the minim fix temperature of the toner can be controlled by the shell polymer, for example with a shell polymer with a $M_w$ of about 15,000 to about 35,000 the MFT as measured by the standard technique as detailed in Example I is about 120° to about 175° C. With further respect to the gloss when the amount of the crosslinked core is low such as 0.1 weight percent of the latex particle composition, the image gloss generated from the toner would be relatively high, such as for example over 70 GGU. With a higher amount of crosslinked core such as for example about 30 weight percent of latex particle composition, the image gloss generated from the toner is relatively low, such as for example about 15 GGU.

The crosslinked polymer can be any known suitable crosslinked polymer inclusive of the linear polymers with crosslinking. In general, these crosslinked polymers can be generated by the polymerization of vinyl monomers in the presence of a crosslinking agent such as divinylbenzene, and which crosslinking agent is selected in various suitable amounts, for example, in the amount ranging from less than about 0.01 weight percent to over about 20 and from about 1 to about 10 weight percent of the total amount of the monomers used. Illustrative crosslinked polymers generated from vinyl monomers crosslinked with a known crosslinking agent, such as divinylbenzene, include those selected from the group consisting of, for example, a crosslinked poly(styrene-alkyl acrylate), poly(styrene-butadiene), poly (styrene-isoprene), poly(styrene-alkyl methacrylate), poly (styrene-alkyl acrylate-acrylic acid), poly(styrene-butadiene-acrylic acid), poly(styrene-isoprene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), and a crosslinked poly(alkyl acrylate-acrylonitrile-acrylic acid). Crosslinked polymers include crosslinked polymers derived from the emulsion polymerization of vinyl monomers selected preferably from the group consisting of styrene and its derivatives, dienes, acrylates, and methacrylates. Examples of acrylates include methyl acrylate, ethyl acrylate, propyl acrylate, butyl acrylate, pentyl acrylate, ethylhexyl acrylate and the like, while examples of methacrylates include methyl methacrylate, ethyl methacrylate, propyl methacrylate, butyl methacrylate, and the like. The crosslinked polymer core is present in various suitable amounts, such as for example, an amount ranging from about 0.1 to about 75 and from about 5 to about 40 weight percent of the latex composition, and the linear shell polymer is present in suitable amount of for example, from about 30 to about 99.9 and from about 95 to about 60 weight percent of the latex composition.

Illustrative examples of linear latex polymers selected for the process of the present invention include known polymers free or substantially free of crosslinking, such as poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butylacrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butylacrylate-isoprene), poly(styrene-butylacrylate), poly(styrene-propyl acrylate), poly(styrene-ethyl acrylate, poly(styrene-butylacrylate-acrylic acid), poly (styrene-propyl acrylate-acrylic acid); polymers such as poly(styrene-butadiene-acrylic acid), poly(styrene-butadiene-methacrylic acid), and the like. The linear polymers and crosslinked polymers selected, which in embodiments can be poly(styrene-acrylates), poly(styrene-butadienes), or poly(styrene-methacrylates) are present in various effective amounts, such as from about 85 weight percent to about 98 weight percent of the toner composition, and which latex size can be, for example, of about 0.01 micron to about 2 micron in average volume diameter as measured by the Brookhaven nanosize particle analyzer.

The image gloss characteristics provided by the toners of the present invention are dependent, for example, on the amount and crosslink density of the crosslinked latex polymer. In embodiments of the present invention, an effective crosslink density of the latex is provided by incorporating therein from about 0.01 to about 25 weight percent of a divinyl monomer, such as divinyl benzene, during the emulsion polymerization of the core monomer.

Also, with the present invention there can be obtained toners which provide matte images of gloss values of less than about 20, and more specifically, from about 5 to about 20 GGU by incorporating into the toner a higher percentage of the crosslinked latex particles of, for example, from about 20 to over 50, and more specifically, about 30 weight percent of the toner composition.

The colorant dispersion depends primarily on the form of the colorant utilized. In some instances, colorants available in the wet cake form or concentrated form containing water can be easily dispersed in water in the presence of suitable surfactants by high shear mixing or homogenization. Also, the colorants are available in a dry form, whereby a dispersion in water is preferably effected by microfluidizing using, for example, an M-110 microfluidizer and passing the colorant dispersion from about 1 to about 10 times through the chamber of the microfluidizer, or by sonication, such as using a Branson 700 sonicator, with the optional addition of dispersing agents such as by utilizing the aforementioned ionic or nonionic surfactants.

Various known colorants, that is for example, pigments, dyes, mixtures of pigments, mixtures of dyes, mixtures of pigments and dyes, and the like, present in the toner in a suitable amount of, for example, from about 1 to about 25 percent by weight of the toner, and preferably in an amount of from about 1 to about 15 weight percent that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments and dyes, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are cyan, magenta, or yellow and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans are copper tetra (octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants with the process of the present invention. Other colorants may be selected, for example components that will impart color to the toner, such as dyes like food dyes, mixtures of dyes and pigments, and the like.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like boron, aluminum, zinc and chromium complexes of salicylic acids, and the like.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example, from about 0.01 to about 10 percent by weight, and preferably from about 0.1 to about 5 percent by weight of monomers used in latex emulsion preparation.

Examples of ionic surfactants include anionic and cationic surfactants with examples of anionic surfactants being, for example, sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like. An effective concentration of the ionic surfactant generally employed is, for example, from about 0.01 to about 10 percent by weight, and preferably from about 0.1 to about 5 percent by weight of monomers used to prepare the latex emulsions.

Cationic surfactant selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to about 4, and preferably from about 0.5 to about 2.

Additional optional surfactants added to the aggregated suspension to primarily stabilize the aggregates from further growing in size, or for minimizing growth, can be selected from anionic surfactants of, for example, sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as an aggregate stabilizer is, for example, from about 0.01 to about 10 percent by weight, and preferably from about 0.5 to about 5 percent by weight of the total weight of the aggregate suspension comprised of latex and colorant particles, optional charge control agent, water, ionic and nonionic surfactants.

Surface additives that can be added to the toner compositions after washing or drying include, for example, metal salts, metal salts of fatty acids, colloidal silicas, silicas, coated silicas, titanates, such as stronium titanate, metal oxides, like titanium dioxide, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include titanium dioxide, zinc stearate and AEROSIL R972™ available from Degussa in amounts of from 0.1 to 2 percent which can be added during the aggregation or washing process, or blended into the final toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various species of the present invention. These Examples are intended to be illustrative only and are not intended to limit the scope of the present invention.

EXAMPLE I

A crosslinked latex emulsion (a) comprised of crosslinked polymer particles derived from emulsion polymerization of styrene, butyl acrylate and divinylbenzene was prepared as follows. An organic phase was prepared by blending 84.0 grams of styrene, 49.0 grams of butyl acrylate, and 7.0 grams of divinylbenzene. An aqueous phase was prepared by mixing an aqueous solution of 1.4 grams of ammonium persulfate in 200 milliliters of water with 935 milliliters of an aqueous solution of 12.3 grams of anionic surfactant, NEOGEN R™ (which contains 60 weight percent of active sodium dodecyl benzene sulfonate in water). The organic phase was then added to the aqueous phase, and stirred at room temperature, about 25° C. throughout, while purging with nitrogen at about 20° C. for 30 minutes. The resulting mixture was subsequently stirred and heated to 50° C. at a rate of 1° C. per minute, followed by heating to 60° C. at a rate of 0.5° C. per minute, and then to 70° C. at a rate of 0.25° C. per minute and retained at this temperature for 4 hours. The resulting crosslinked latex polymer which contained 5 weight percent of polymerized divinylbenzene, displayed a mid-point Tg of 56.3° C. and a particle size of 50 nanometers as measured on a Nicomp 360 particle sizer.

A core/shell latex emulsion (b) comprised of crosslinked latex particles (a) and a linear polymer shell was prepared by seed polymerization of polystyrene, butyl acrylate and acrylic acid onto the above prepared crosslinked latex seeds (a) as follows. An organic phase was prepared by blending 319.1 grams of styrene, 70.06 grams of butyl acrylate, 7.78 grams of acrylic acid, 3.9 grams of carbon tetrabromide and 11.7 grams of dodecanethiol. An aqueous surfactant phase was prepared by mixing 9.7 grams of anionic surfactant, NEOGEN RK™ (which contains 60 weight percent of active sodium dodecyl benzene sulfonate in water), and 8.3 grams of nonionic surfactant, ANTAROX CA 897™ (which contains 70 weight percent of active polyoxyethylene nonyl phenyl ether in water) in 217.3 milliliters of deionized water. The organic phase was then added to the aqueous surfactant phase and homogenized at room temperature, about 25° C. throughout, for 5 minutes to provide the pre-emulsion feed. An aqueous initiator phase was prepared by mixing 3.9 grams of ammonium persulfate in 35.4 milliliters of deionized water. The seed reactor charge was prepared by mixing 252.7 grams of the crosslinked latex seeds (a) in 468.2 grams of deionized water. The seed reactor charge was stirred and heated to 70° C., while purging with nitrogen. Subsequently, the aqueous initiator solution and the pre-emulsion feed were fed simultaneously into the seed suspension at 70° C. over a period of 3 hours. The initiator solution was fed via syringe pump at a constant rate of 0.2 milliliter per minute while the pre-emulsion was fed via metering pump at an increasing rate of speed in the following order: 1.2 milliliters per minute for 30 minutes, 2.3 milliliters per minute for 30 minutes, 3.5 milliliters per minute for 30 minutes, 4.6 milliliters per minute for 30 minutes, 5.7 milliliters per minute for 30 minutes, and finally 7.0 milliliters per minute for 30 minutes. The resulting mixture was stirred and heated at 70° C. for 2.7 hours. The resulting core/shell latex polymer displayed a mid-point Tg of 55.4° C. and a particle size of 126 nanometers as determined by the Nicomp 360 particle sizer, and the shell polymer displayed an $M_w$ of 18,600 and an $M_n$ of 5,000 as determined by measuring the tetrahydrofuran-soluble component of the latex, and the shell thickness was about 38 nanometers.

347.0 Grams of the latex emulsion comprised of 32.3 weight percent of the prepared core/shell latex particles having a core derived from 60 weight percent of styrene, 35 weight percent of butyl acrylate and 5 weight percent of divinyl benzene, and a shell derived from 80 weight percent of styrene, 18 weight percent of butyl acrylate and 2 weight percent of acrylic acid, and 228.0 grams of an aqueous cyan pigment dispersion containing 4.0 grams of dispersed Cyan Pigment 15:3, and 2.3 grams of the cationic surfactant, SANIZOL B™, were simultaneously added to 400 milliliters of water with high shear stirring by means of a polytron. The mixture was transferred to a 2 liter reaction vessel and heated at a temperature of 50° C. for 1.0 hour before 20 milliliters of 20 percent aqueous NEOGEN R™ solution were added. Subsequently, the mixture was heated to 95° C. and retained at this temperature for a period of 4 hours. The resulting toner product was cooled, filtered, washed with water, and dried in a freeze dryer. The resulting toner which was comprised of about 90 weight percent of the non-crosslinked linear polymer resin, about 6.3 weight percent of the crosslinked polymer particles, and about 3.7 weight percent of the cyan pigment evidenced a particle size of 6.7 microns in volume average diameter and a GSD of 1.20 as measured with a Coulter Counter.

Standard fusing properties of the prepared toner were evaluated as follows. Unfused images of the toner on paper with a controlled toner mass per unit area of 1.2 milligrams/$cm^2$ were produced in accordance with the following procedure. A suitable electrophotographic developer was generated by mixing from 2 to 10 percent by weight of the toner with a suitable electrophotographic carrier, such as, for example, a 90 micron diameter ferrite core, spray coated with 0.5 weight percent of a terpolymer of poly(methyl methacrylate), styrene, and vinyltriethoxysilane, and roll milling the mixture for 10 to 30 minutes to produce a tribocharge of between −5 to −20 microcoulombs per gram of toner as measured with a Faraday Cage. The developer was then introduced into a small electrophotographic copier, such as Mita DC-111, in which the fuser system had been disconnected. Between 20 and 50 unfused images of a test pattern of a 65 millimeter by 65 millimeter square solid area were produced on 8½ by 11 inch sheets of a typical electrophotographic paper such as Xerox Image LX© paper.

The unfused images were then fused by feeding them through a hot roll fuser system comprised of a fuser roll and pressure roll with VITON surfaces, both of which were heated to a controlled temperature. Fused images were produced over a range of hot roll fusing temperatures of from about 120° C. to about 210° C. The gloss value of the fused images was measured according to TAPPI Standard T480 at a 75° angle of incidence and reflection using a Novo-Gloss© Statistical Glossmeter, Model GL-NG1002S from Paul N. Gardner Company, Inc. The degree of permanence of the fused images was evaluated by the known Crease Test. The fused image was folded under a specific weight with the toner image to the inside of the fold. The image was then unfolded and any loose toner wiped from the resulting crease with a cotton swab. The average width of the paper substrate which shows through the fused toner image in the vicinity of the crease was measured with an image analysis system.

The fusing performance of a toner is traditionally judged from the fusing temperature required to achieve acceptable image gloss and fix. For different applications varying image gloss is required. The minimum fuser temperature required to produce a crease value less than the maximum acceptable crease of traditionally 65 crease units, is known as the Minimum Fix Temperature (MFT) for a given toner. The gloss level attained at this temperature will dictate the gloss of the final image.

The toner obtained in this Example was evaluated in accordance with the above procedure, and possessed a MFT of 155° C., and a gloss value of 67 GGU at 160° C.

EXAMPLE II

A latex emulsion (c) comprised of core/shell latex particles with a core derived from crosslinked latex (a) and a linear polymer shell derived from styrene/butylacrylate/acrylic acid with a composition of, respectively, 78/20/2 by weight was prepared from 311.3 grams of styrene, 77.8 grams of butyl acrylate, and 7.78 grams of acrylic acid in accordance with the preparative procedure for core/shell latex emulsion (b) as described in Example I. The resulting core/shell latex polymer displayed a mid-point Tg of 52.4° C. and a particle size of 124 nanometers as determined by the Nicomp 360 particle sizer while its shell polymer displayed an $M_w$ of 19,300 and an $M_n$ of 5,100, and the thickness of the shell was about 37 nanometers.

347.0 Grams of the latex emulsion (c) as prepared above and 228.0 grams of an aqueous cyan pigment dispersion containing 4.0 grams of dispersed Cyan Pigment 15:3, and 2.6 grams of cationic surfactant, SANIZOL B™, were simultaneously added to 400 milliliters of water with high shear stirring by means of a polytron. The resulting mixture was then transferred to a 2 liter reaction vessel and heated at a temperature of 48° C. for 2.0 hours before 35 milliliters of 20 percent aqueous NEOGEN R™ solution were added. Subsequently, the mixture was heated to 93° C. and retained at this temperature for a period of 4 hours, before cooling down to room temperature. The resulting toner was filtered, washed with water, and dried in an oven. The resulting toner product, comprised about 90 weight percent of the linear polymer resin, about 6.3 weight percent of the crosslinked polymer particles, and about 3.7 weight percent of the cyan pigment showed a particle size of 6.4 microns in volume average diameter with a GSD of 1.19 as measured with a Coulter Counter. When evaluated in accordance with the procedure of Example I, the toner displayed an MFT of 154° C. and a gloss value of 66 GGU at 160° C.

EXAMPLE III

A crosslinked latex emulsion (d) comprised of crosslinked polymer particles derived from 119.0 grams of styrene, 14.0 grams of butyl acrylate, and 7 grams of divinyl benzene was prepared in accordance with the preparative procedure for crosslinked latex emulsion (a) as described in Example I. The resulting crosslinked latex polymer which contained 5 weight percent of polymerized divinylbenzene, displayed a mid-point Tg of 96.0° C. and a particle size of 62 nanometers as measured on a Nicomp 360 particle sizer. A core/shell latex emulsion (e) comprised of a core derived from crosslinked latex emulsion (d) and a linear polymer shell derived from a styrene/butylacrylate/acrylic acid mixture of respectively 80/18/2 by weight was prepared from crosslinked latex emulsion (d) in accordance with the preparative procedure for core/shell latex emulsion (b) as described in Example I with the exception that 7.78 grams of dodecanethiol and 1.95 grams of carbon tetrabromide were utilized instead of 11.7 grams and 3.9 grams respectively. The resulting core/shell latex polymer displayed a mid-point Tg of 58.9° C. and a particle size of 122 nanometers as determined by the Nicomp 360 particle sizer, while its shell polymer displayed an $M_w$ of 30,100 and an $M_n$ of 5,800, and the shell thickness was about 30 nanometers.

347.0 Grams of the latex emulsion (e) as prepared above, and 228.0 grams of an aqueous cyan pigment dispersion containing 4.0 grams of dispersed Cyan Pigment 15:3, and 2.3 grams of the SANIZOL B™ were simultaneously added to 400 milliliters of water with high shear stirring by means of a polytron. The mixture was transferred to a 2 liter reaction vessel and heated at a temperature of 50° C. for 2 hour before 28 milliliters of 20 percent aqueous NEOGEN R™ solution were added. Subsequently, the mixture was heated to 96° C. and retained at this temperature for a period of 5 hours before cooling down to room temperature and filtered. The resulting toner was washed with water and dried in a freeze dryer. The toner product obtained comprised of about 90.0 weight percent of linear polymer resin, about 6.3 weight percent of crosslinked polymer particles, and about 3.7 weight percent of the cyan pigment evidenced a particle size of 6.9 microns in volume average diameter, with a GSD of 1.22 as measured with a Coulter Counter. The prepared toner, when evaluated in accordance with the procedure of Example I, exhibited an MFT of 147° C. and a gloss value of 62 GGU at 160° C.

EXAMPLE IV

A core/shell latex emulsion (f) comprised of latex particles with a 9.5 weight percent of crosslinked core polymer (a) and 90.5 weight percent of linear shell polymer derived from a styrene/butyl acrylate/acrylic acid mixture of respectively 80/18/2 by weight was prepared from 364.4 grams of the crosslinked latex emulsion (a), 309.2 grams of styrene, 67.9 grams of butyl acrylate, and 7.54 grams of acrylic acid in accordance with the preparative procedure for core/shell latex emulsion (b) as described in Example I. The resulting core/shell latex polymer displayed a mid-point Tg of 57.4° C. and a particle size of 119 nanometers as determined by the Nicomp 360 particle sizer, while its shell polymer displayed an $M_w$ of 17,400 and an $M_n$ of 5,200, and the shell thickness was about 35 nanometers.

347.0 Grams of latex emulsion (f) and 228.0 grams of an aqueous cyan pigment dispersion containing 4.0 grams of dispersed Cyan Pigment 15:3, and 2.1 grams of cationic surfactant, SANIZOL B™, were simultaneously added to 400 milliliters of water with high shear stirring by means of a polytron. The mixture was transferred to a 2 liter reaction vessel and heated at a temperature of 49° C. for 2.0 hours before 35 milliliters of 20 percent aqueous NEOGEN R™ solution were added. Subsequently, the mixture was heated to 95° C. and retained at this temperature for a period of 3.5 hours before cooling down to room temperature. The resulting toner was filtered, washed with water, and dried in an oven. The resulting toner product contained about 87.1 weight percent of the above linear polymer resin, about 9.1 weight percent of the above crosslinked polymer particles, and about 3.7 weight percent of the 15:3 cyan pigment, evidenced a particle size of 6.7 microns in volume average diameter with a GSD of 1.18 as measured with a Coulter Counter. When evaluated in accordance with the procedure of Example I, the above toner displayed an MFT of 156° C. and a gloss value of 53 GGU at 160° C.

EXAMPLE V

A core/shell latex emulsion (g) comprised of latex particles with a 30 weight percent of crosslinked core polymer (a) and 70 weight percent of linear shell polymer derived from a styrene/butylacrylate/acrylic acid mixture of respectively 80/18/2 by weight was prepared from 1150.74 grams of the crosslinked latex emulsion (a), 239.2 grams of styrene, 52.5 grams of butyl acrylate, 5.60 grams of acrylic, 7.29 grams of dodecanethiol, 2.92 grams of carbontetrabromide, 2.92 grams of ammonium persulfate, 4.86 grams of NEOGEN R™, and 2.50 grams of ANTAROX CA 897™ in accordance with the preparative procedure for core/shell latex emulsion (b) as described in Example I. The resulting core/shell latex polymer displayed a mid-point Tg of 56.5° C. and a particle size of 112 nanometers as determined by the Nicomp 360 particle sizer, while the shell polymer displayed an $M_w$ of 23,400 and an $M_n$ of 5,300, and the shell polymer was about 31 nanometers in thickness.

347.0 Grams of latex emulsion (g) and 228.0 grams of an aqueous cyan pigment dispersion containing 4.0 grams of dispersed Cyan Pigment 15:3, and 2.3 grams of cationic surfactant, SANIZOL B™, were simultaneously added to 400 milliliters of water with high shear stirring by means of a polytron. The mixture was transferred to a 2 liter reaction vessel and heated at a temperature of 48° C. for 2.5 hours before 35 milliliters of 20 percent aqueous NEOGEN R™ solution were added. Subsequently, the mixture was heated to 93° C. and retained at this temperature for a period of 4 hours before cooling down to room temperature. The resulting toner was filtered, washed with water, and dried in an oven. The resulting toner product contained about 68.5 weight percent of the above linear polymer resin, about 27.8 weight percent of the above crosslinked polymer particles, and about 3.7 weight percent of the 15:3 cyan pigment, evidenced a particle size of 6.7 microns in volume average diameter with a GSD of 1.18 as measured with a Coulter Counter. When evaluated in accordance with the procedure of Example I, the above toner displayed an MFT of 149° C. and a gloss value of 18 GGU at 160° C.

COMPARATIVE EXAMPLE

A comparative toner was prepared from a latex containing only a linear polymer without a crosslinked core polymer to for example, compare its image gloss characteristics with those of the toners from the Examples of the present invention.

A latex emulsion derived from emulsion polymerization of styrene, butyl acrylate and acrylic acid was prepared as follows. An organic phase was prepared by blending 492.0 grams of styrene, 108.0 grams of butyl acrylate, 12.0 grams of acrylic acid, 6.0 grams of carbon tetrabromide and 18.0 grams of dodecanethiol. An aqueous phase was prepared by mixing an aqueous solution of 6.0 grams of ammonium persulfate in 200 milliliters of water with 700 milliliters of an aqueous solution of 13.5 grams of anionic surfactant, NEOGEN R™, and 12.9 grams of nonionic surfactant, ANTAROX CA 897™. The organic phase was then added to the aqueous phase, and homogenized at room temperature, about 25° C. throughout, while purging with nitrogen at about 20° C. for 30 minutes. Subsequently, the mixture resulting was stirred and heated to 70° C. at a rate of 1° C. per minute, and retained at this temperature for 6 hours. The resulting latex displayed a particle size of 140 nanometers as determined by the Nicomp 360 particle sizer, an $M_w$ of 20,400, an $M_n$ of 5,100, and a mid-point Tg of 54.9° C.

A cyan toner was prepared in accordance with the procedure of Example V using the latex obtained above instead of the core-shell latex of Example V. The resulting toner which contained about 96.3 percent of the above linear polymer and about 3.7 weight percent of the 15:3 cyan pigment, evidenced a particle size of 6.9 microns in volume average diameter with a GSD of 1.22 as measured with a Coulter Counter. When evaluated in accordance with the procedure of Example I, the above toner displayed an MFT of 164° C. and a gloss value of 71 GGU at 160° C. as compared to a matte image of gloss value of 18 GGU of the toner of Example V containing a crosslinked polymer.

Other modifications of the present invention may occur to those of ordinary skill in the art subsequent to a review of the present application and these modifications, including equivalents thereof, are intended to be included within the scope of the present invention.

What is claimed is:

1. A process for the preparation of toner comprising (i) blending (a) a colorant dispersion containing a first ionic surfactant with (b) a latex emulsion comprised of an aqueous dispersion of core-shell polymer particles with a crosslinked polymer core and a linear polymer shell, and optional nonionic surfactant and a second ionic surfactant with a charge polarity opposite to that of said first ionic surfactant in said colorant dispersion;

(ii) heating the resulting mixture at about below the glass transition temperature (Tg) of the linear latex shell polymer to form aggregates; and (iii) subsequently heating said aggregates about above the Tg of the linear latex shell polymer to effect coalescence and fusion of said aggregates.

2. A process in accordance with claim 1 wherein the temperature at which the aggregates are formed in (ii) controls the size of said aggregates, and which aggregates are from about 2 to about 10 microns in volume average diameter.

3. A process in accordance with claim 1 wherein the crosslinked polymer is a linear polymer that has been crosslinked.

4. A process in accordance with claim 1 wherein the crosslinked core polymer is selected from the group consisting of crosslinked poly(styrene-alkyl acrylate), poly (styrene-butadiene), poly(styrene-isoprene), poly(styrene-alkyl methacrylate), poly(styrene-alkyl acrylate-acrylic acid), poly(styrene-butadiene-acrylic acid), poly(styrene-isoprene-acrylic acid), poly(styrene-alkyl methacrylate-acrylic acid), poly(alkyl methacrylate-alkyl acrylate), poly (alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), and poly (alkyl acrylate-acrylonitrile-acrylic acid).

5. A process in accordance with claim 1 wherein the crosslinked polymer particles are present in an amount of from about 0.1 to about 70 weight percent, or wherein the crosslinked polymer particles are present in an amount of from about 20 to about 50 weight percent of the toner, and wherein the linear polymer is present in an amount of from about 25 to about 95 weight percent of the toner, or wherein the linear polymer is present in an amount of from about 40 to about 75 weight percent of the toner.

6. A process in accordance with claim 1 wherein the linear shell polymer $M_w$ is from about 15,000 to about 50,000, and the crosslinked polymer is optionally derived from the polymerization of vinyl monomers with a crosslinking agent in the amount of from 0.01 to over 20 weight percent of total monomers.

7. A process in accordance with claim 1 wherein the toner possesses an image gloss value of from about 5 GGU to about 75 GGU.

8. A process in accordance with claim 1 wherein the surfactant in the aqueous colorant dispersion is a cationic surfactant, the surfactant in the latex blend is comprised of nonionic and anionic surfactants, or the surfactant in the colorant dispersion is an anionic surfactant, and the surfactant in the latex blend is comprised of nonionic and cationic surfactants.

9. A process in accordance with claim 1 wherein the colorant dispersion contains water and is prepared by homogenizing a colorant in water in the presence of a suitable surfactant, which homogenizing is at from about 1,000 revolutions per minute to about 10,000 revolutions per minute, at a temperature of from about 25° C. to about 55° C., and for a duration of from about 1 minute to about 120 minutes.

10. A process in accordance with claim 1 wherein the colorant dispersion is prepared by mixing a colorant in water with an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

11. A process in accordance with claim 1 wherein the heating (ii) is accomplished at temperatures of from about 25° C. to about 1° C. below the Tg of the linear shell polymer for a duration of from about 0.5 hour to about 6 hours.

12. A process in accordance with claim 1 wherein the linear shell polymer is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(styrene-butyl acrylate-acrylonitrile-acrylic acid), poly(acrylonitrile-butyl acrylate-acrylic acid), and the crosslinked polymer is comprised of said linear polymer with crosslinking.

13. A process in accordance with claim 1 wherein the linear shell polymer is poly(styrene-butylacrylate), poly (styrene-butyl acrylate-acrylic acid), poly(styrene-butadiene), poly(styrene-butadiene-acrylic acid), poly (styrene-butyl acrylate-acrylonitrile), or poly(styrene-butyl acrylate-acrylonitrile-acrylic acid), and the crosslinked resin is the crosslinked derivative of poly(styrene-butyl acrylate), poly(styrene-butyl acrylate-acrylic acid), poly(styrene-butadiene), poly(styrene-butadiene-acrylic acid), poly (styrene-butyl acrylate-acrylonitrile), or poly(styrene-butyl acrylate-acrylonitrile-acrylic acid).

14. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol, and wherein the ionic surfactant is selected from the group consisting of sodium dodecyl sulfate, sodium dodecylbenzene sulfate, sodium dodecylnaphthalene sulfate.

15. A process in accordance with claim 1 wherein the colorant is carbon black, cyan, yellow, magenta, or mixtures thereof.

16. A process in accordance with claim 1 wherein the surfactants are each present in an amount of from about 0.1 to about 5 weight percent of the reaction mixture.

17. A process in accordance with claim 1 wherein there is added to the surface of the formed toner metal salts, metal salts of fatty acids, silicas, metal oxides, or mixtures thereof, each in an amount of from about 0.1 to about 10 weight percent of the obtained toner.

18. A process in accordance with claim 1 wherein subsequent to (iii) cooling is accomplished and the resulting toner is washed with water or aqueous base at a temperature of from about 25° C. to about 75° C. primarily to remove residual surfactants from the toner, and wherein the coalescence and fusion (iii) is accomplished at a temperature of from about 10° C. to about 50° C. above the Tg of the linear shell polymer, or at a temperature of about 80° C. to about 100° C.

19. A process in accordance with claim 1 wherein the shell is of a thickness of from about 5 nanometers to about 300 nanometers.

20. A process for the preparation of a core-shell comprised of the polymerization of vinyl monomers onto a crosslinked polymer seed, and which core shell can be selected for the preparation of the toner compositions.

21. A process in accordance with claim 1 wherein there is provided mechanically stable integral toner particles of polymers and colorant.

22. A process in accordance with claim 1 wherein subsequent to (iii) the suspension is cooled, and the toner is isolated.

23. A process comprising (i) mixing (a) a dispersion comprised of a colorant containing a first ionic surfactant with (b) a latex emulsion, and wherein the latex is comprised of a crosslinked polymer core and a linear polymer shell, and a second ionic surfactant with a charge polarity opposite to that of said first ionic surfactant in said colorant;

(ii) heating the resulting mixture at about equal to, or about below the glass transition temperature (Tg) of the linear latex shell polymer;

(iii) heating said resulting mixture suspension about equal to, or about above the Tg of the linear latex shell polymer; and optionally cooling, and optionally isolating the product.

24. A process in accordance with claim 23 wherein the heating in (ii) results in the formation of aggregates, the heating in (iii) results in the fusion of the aggregates, the product is isolated, and which product is a toner.

25. A process in accordance with claim 23 wherein said latex is generated by the emulsion polymerization of a mixture of monomers and crosslinking component, followed by the addition of monomers and polymerization to enable said latex with a crosslinked core polymer and a shell polymer thereover.

26. A process in accordance with claim 25 wherein the polymerization of the monomers to provide the core polymer is accomplished by heating at a temperature of about 50° C. to about 95° C., the amount of crosslinking component is from about 0.1 to about 20 weight percent of total monomers, the crosslinked core particles possess a size diameter of about 25 to about 300 nanometers, cooling is accomplished after core polymer polymerization, the linear shell polymer is formed on the core polymer particles by simultaneous feedings of an aqueous monomer dispersion and an aqueous initiator solution into the core polymer particle suspension at a temperature of about 50° C. to about 95° C. over a period of about 30 minutes to 6 hours, the shell polymer $M_w$ is about 15,000 to about 40,000, and its $M_n$ is about 4,000 to about 15,000.

27. A process in accordance with claim 26 wherein the image gloss value of the toner obtained from the said latex is about 5 to about 75 GGU, and the MFT of the toner is about 120° C. to about 185° C.

28. A process in accordance with claim 1 wherein the toner resulting is washed to primarily remove surfactants.

29. A process in accordance with claim 1 wherein the toner possesses an image gloss value of about 75 GGU at the toner MFT melt fusing temperature of from about 120° C. to about 185° C.

30. A process in accordance with claim 1 wherein the toner possesses a low gloss values enabled by the presence of from about 5 to about 70 weight percent of crosslinked polymer particles.

* * * * *